US009834400B2

(12) United States Patent
Liu

(10) Patent No.: US 9,834,400 B2
(45) Date of Patent: Dec. 5, 2017

(54) PRINTER

(71) Applicant: KONINKLIJKE PHILIPS N.V., Eindhoven (NL)

(72) Inventor: Gao Jian Liu, Shenzhen (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/354,143

(22) PCT Filed: Oct. 30, 2012

(86) PCT No.: PCT/IB2012/056012

§ 371 (c)(1),
(2) Date: Apr. 25, 2014

(87) PCT Pub. No.: WO2013/064975

PCT Pub. Date: May 10, 2013

(65) Prior Publication Data

US 2014/0319193 A1 Oct. 30, 2014

(30) Foreign Application Priority Data

Nov. 3, 2011 (CN) ..... 2011 1 0343144

(51) Int. Cl.
*B65H 35/00* (2006.01)
*B41J 11/70* (2006.01)

(52) U.S. Cl.
CPC ..... *B65H 35/0006* (2013.01); *B41J 11/70* (2013.01); *B65H 2301/51514* (2013.01); *Y10T 225/205* (2015.04)

(58) Field of Classification Search
CPC ..... B65H 35/0006; B65H 2301/51514; B41J 11/70; Y10T 225/205
USPC ..... 225/72, 91, 89, 67, 10; 400/621
See application file for complete search history.

(56) References Cited

U.S. PATENT DOCUMENTS 4,422,787 A 12/1983 Guthrie
4,568,211 A * 2/1986 Fox et al. ..... 400/621
4,586,639 A * 5/1986 Ruff et al. ..... 225/1
4,592,669 A * 6/1986 Lohse et al. ..... 400/621
(Continued)

FOREIGN PATENT DOCUMENTS

CN 1187428 A 7/1998
CN 2427321 Y 4/2001
(Continued)

*Primary Examiner* — Omar Flores Sanchez

(57) ABSTRACT

A printer includes a housing; an openable top cover disposed at the top of the housing; a printing unit disposed in the housing and comprising a printing portion fixedly mounted within the housing and a roll portion fixed to the openable top cover; and a paper channel between the printing portion and the roll portion; and a paper outlet between a top portion of the housing and the openable top cover, the paper channel leading to the paper outlet the printer further including a movable paper-tearing mechanism disposed in the paper outlet, the movable paper-tearing mechanism moving away from the paper outlet when the openable top cover is opened and into the paper outlet and overlapping partly the openable top cover when the openable top cover is closed, where an extension of the paper channel is between the movable paper-tearing mechanism and an upper surface of the openable top cover.

7 Claims, 5 Drawing Sheets

(56) References Cited

U.S. PATENT DOCUMENTS

| | | | | | |
|---|---|---|---|---|---|
| 4,668,960 | A | * | 5/1987 | Okamura | 346/24 |
| 4,806,036 | A | * | 2/1989 | Ward et al. | 400/691 |
| 4,840,506 | A | * | 6/1989 | Kashiwagi | 400/621 |
| 5,040,912 | A | * | 8/1991 | Koizumi et al. | 400/690.4 |
| 5,244,295 | A | * | 9/1993 | Terashima et al. | 400/639 |
| 6,325,558 | B1 | | 12/2001 | Robinson | |
| 6,793,423 | B1 | * | 9/2004 | Saito | B41J 11/70<br>101/93.07 |
| 7,883,283 | B2 | * | 2/2011 | Oshida | B26D 7/22<br>346/24 |

FOREIGN PATENT DOCUMENTS

| | | | |
|---|---|---|---|
| CN | 201304759 | Y | 9/2009 |
| CN | 10167071 | A | 3/2010 |
| CN | 101670716 | A | 3/2010 |
| CN | 201728902 | U | 2/2011 |
| CN | 202378436 | U | 8/2012 |

* cited by examiner

PRINTER

The present invention relates to a printer, especially to a printer comprising a paper-tearing mechanism.

DESCRIPTION OF THE BACKGROUND ART

A printer usually comprises a housing, a printing unit disposed in the housing and an openable top cover disposed at the top of the housing. The printing unit comprises a printing portion fixedly mounted within the housing and a roll portion fixed to the openable top cover. A paper channel is defined between the printing portion and the roll portion. The paper is printed under thermal effect when it passes through the paper channel and is outputted from the printer through a paper outlet.

CN101670716A discloses a printer in which the paper outlet is disposed between the housing and the openable top cover so as to be opposite said openable top cover. An edge of the housing defining the paper outlet is designed as a serrated edge to act as a paper-tearing mechanism. When the paper is being torn off, two portions of the paper on either side of the paper-tearing mechanism usually form an obtuse angle so that it is difficult to tear off the paper and the paper thus is irregularly and roughly torn off. The paper outlet of another conventional printer is disposed in the openable top cover. An edge of the openable top cover defining the paper outlet is designed as a serrated edge to act as a paper-tearing mechanism. When the paper is being torn off, two portions of the paper on either side of this paper-tearing mechanism usually form an acute angle so that it is easy to tear off the printed paper. However, it is necessary to manually insert the paper through the paper outlet disposed in the openable top cover when the openable top cover of the printer is opened to load the paper. This operation is very inconvenient and troublesome.

As a result, there is a need to make some improvements on the conventional printer.

SUMMARY OF THE INVENTION

An object of the present invention is to eliminate the above drawbacks in the prior art, and provide a printer which is not only capable of causing two portions of the paper on either side of the paper-tearing mechanism to form an acute angle so that the printed paper can be easily torn off, but which is also capable of rendering superfluous the operation of manually inserting the paper through the paper outlet, thereby enabling more convenient use of the printer.

According to one aspect of the present invention, a printer is provided that comprises:

a housing;

an openable top cover disposed at the top of the housing;

a printing unit disposed in the housing, the printing unit comprising a printing portion fixedly mounted within the housing and a roll portion fixed to the openable top cover, and a paper channel defined between the printing portion and the roll portion; and a paper outlet defined between a top portion of the housing and the openable top cover, the paper channel leading to the paper outlet;

characterized in that the printer further comprises a movable paper-tearing mechanism disposed in the paper outlet, the movable paper-tearing mechanism moving away from the paper outlet when the openable top cover is opened and moving into the paper outlet and overlapping partly the openable top cover when the openable top cover is closed, so that an extension of the paper channel is defined between the movable paper-tearing mechanism and an upper surface of the openable top cover.

Preferably, the movable paper-tearing mechanism is rotatably mounted below the top portion of the housing.

Preferably, the movable paper-tearing mechanism comprises a main body and a supporting shaft extending from two ends of the main body, a torsion spring being attached to the supporting shaft, and the movable paper-tearing mechanism being rotatably mounted below the top portion of the housing by means of the supporting shaft.

Preferably, the movable paper-tearing mechanism and the openable top cover each comprise a mating portion, the mating portions cooperate with each other and overcome a spring force of the torsion spring when the openable top cover is closed, so that the movable paper-tearing mechanism moves into the paper outlet to define the extension of the paper channel.

Preferably, the mating portions comprise a step extending from the main body and a projection on the openable top cover at a position corresponding to the step.

Preferably, the movable paper-tearing mechanism is slidably mounted below the top portion of the housing.

Preferably, the movable paper-tearing mechanism tends to slide inwards relative to the housing under the action of a tension spring so as to move away from the paper outlet.

Preferably, the movable paper-tearing mechanism and the openable top cover each comprise a mating portion, the mating portions cooperate with each other and overcome a spring force of the tension spring when the openable top cover is closed, so that the movable paper-tearing mechanism moves into the paper outlet to define the extension of the paper channel.

Preferably, the movable paper-tearing mechanism has a serrated edge.

Preferably, the printer is a thermal printer.

According to the printer of the present invention, the paper can be loaded in a simple and convenient manner and can be easily torn off, enabling the paper to be torn off in a regular manner and in a straight line.

DETAILED DESCRIPTION OF THE PREFERRED EMBODIMENTS

Hereinafter, the present invention is described in detail with reference to the figures.

Figure 1:
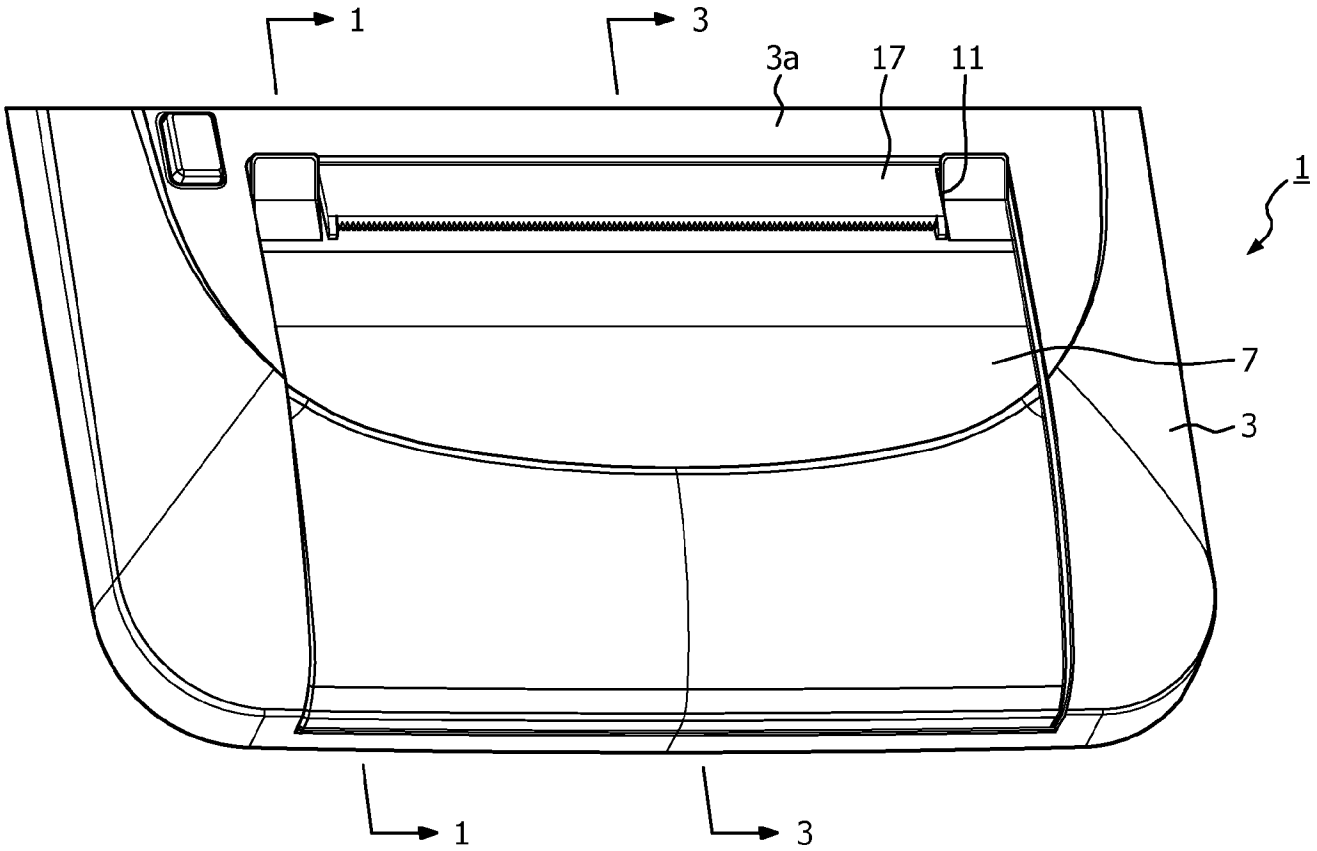
FIG. 1 is a perspective top view of a part of the printer according to the present invention, in which the top cover is in a closed state.
Figure 2:
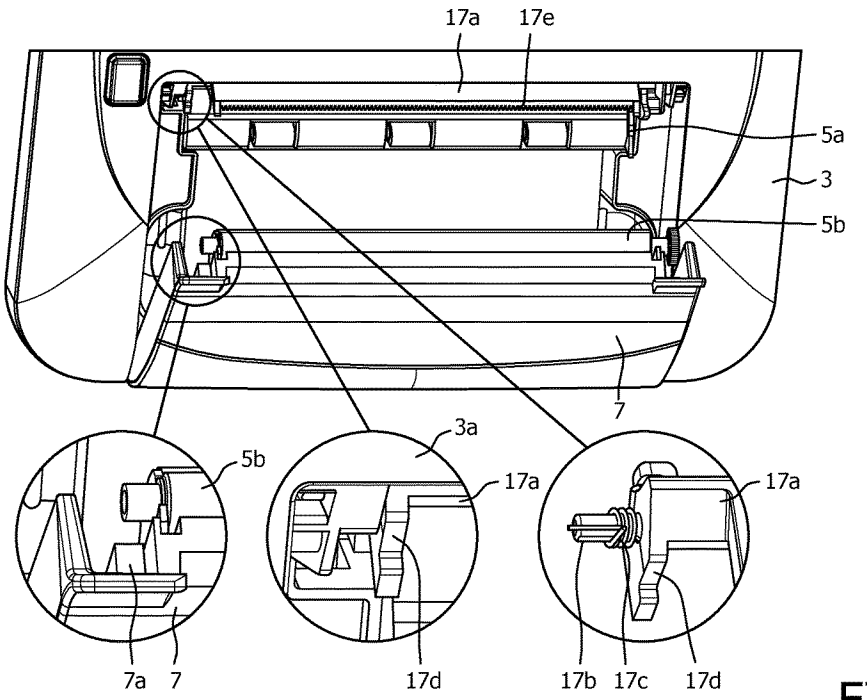
FIG. 2 is a perspective top view of a part of the printer according to the present invention, in which the top cover is in an open state.
Figure 3:
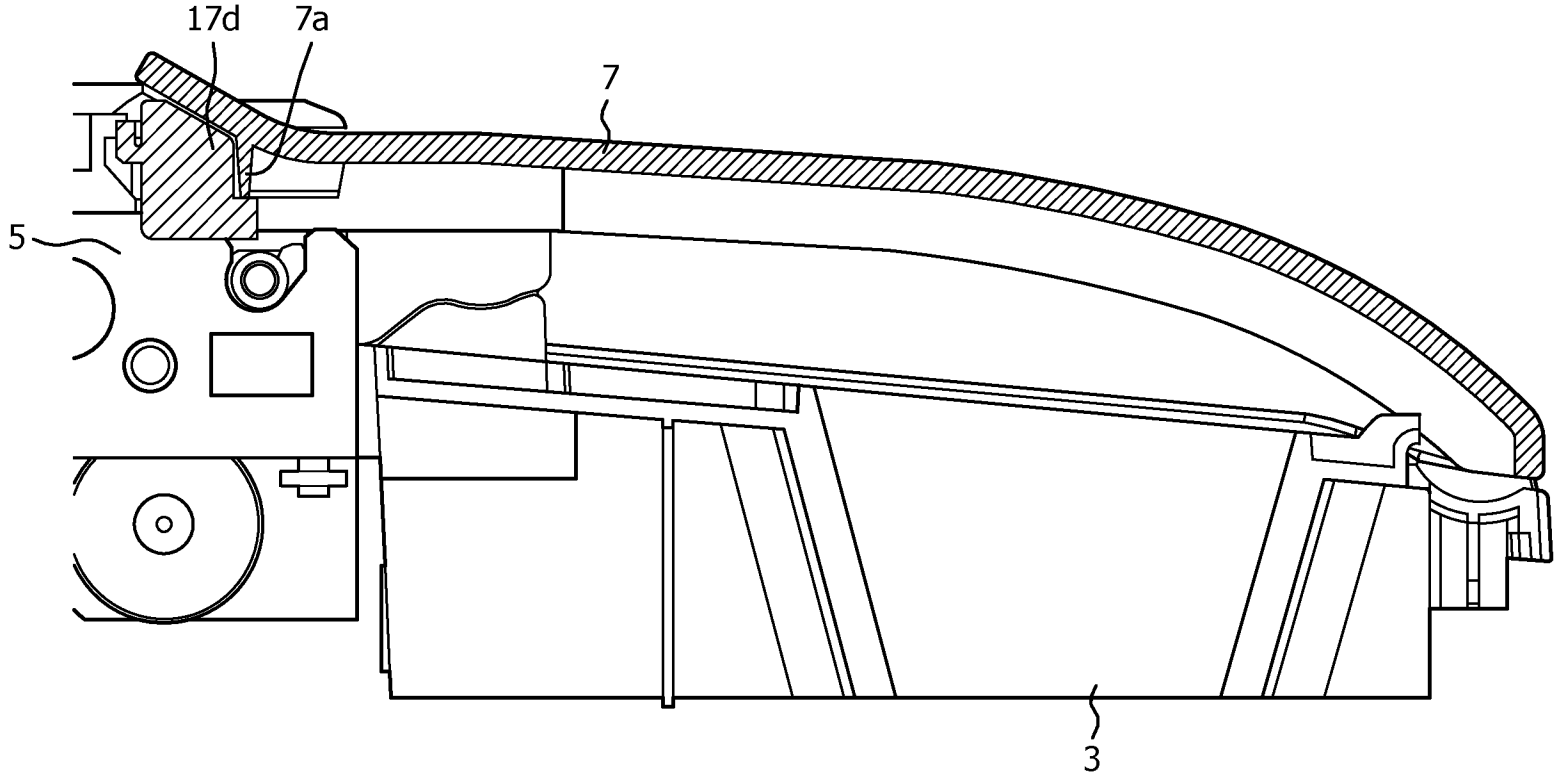
FIG. 3 is a sectional view taken along the line 3-3 of FIG. 1.
Figure 4:
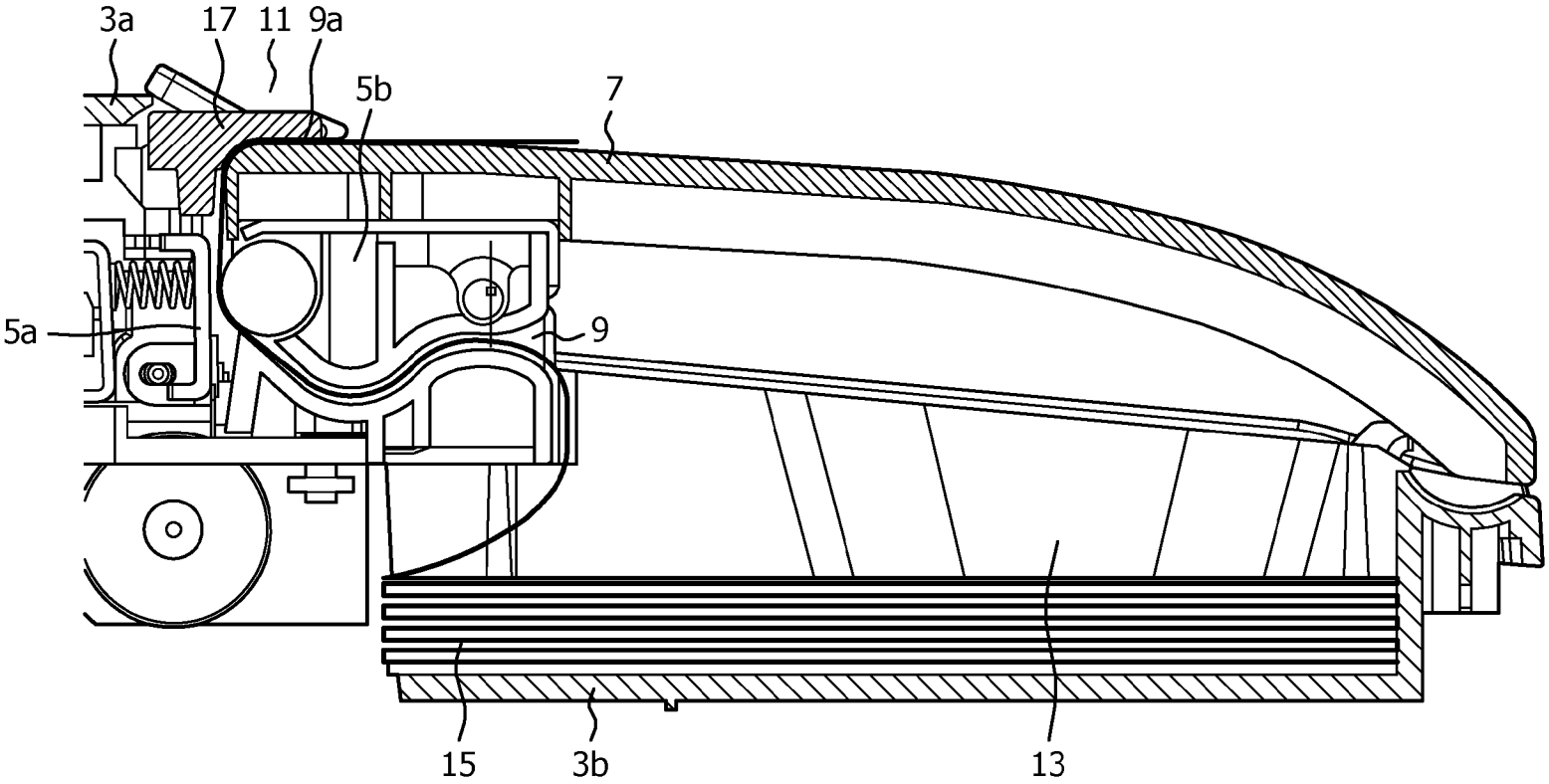
FIG. 4 is a sectional view taken along the line 4-4 of FIG. 1, showing that the paper has been printed by the printer.

FIG. 1 and FIG. 2 schematically show a portion of a printer according to the present invention in a perspective top view, and FIG. 4 is a sectional view taken along the line 4-4 of FIG. 1. As shown in FIGS. 1, 2 and 4, the printer 1 according to the present invention comprises a housing 3, a printing unit 5 disposed in the housing 3 and an openable top cover 7 disposed at the top of the housing 3. The printing unit 5 comprises a printing portion 5*a* fixedly mounted within the housing and a roll portion 5*b* fixed to the openable top cover 7. A paper channel 9 is defined between the printing portion 5*a* and the roll portion 5*b*. The paper channel 9 leads outwards to a paper outlet 11 defined between a top portion 3*a* of the housing 3 and the openable top cover 7. A space 13 for holding the paper 15 is defined between a bottom portion 3*b* of the housing 3 and the openable top cover 7. The paper 15 is printed for example under thermal effect between the printing portion 5*a* and the roll portion 5*b* when it passes through the paper channel 9 and is outputted from the printer through the paper outlet 11.

According to the present invention, the printer 1 further comprises a movable paper-tearing mechanism 17 disposed in the paper outlet 11. The movable paper-tearing mechanism 17 moves away from the paper outlet 11 when the openable top cover 7 is opened to load the paper. When the openable top cover 7 is closed, the movable paper-tearing mechanism 17 moves into the paper outlet 11 and partly overlaps the openable top cover 7 so that an extension 9*a* of the paper channel 9 is defined between the movable paper-tearing mechanism 17 and an upper surface of the openable top cover 7, thereby changing the outputting direction of the printed paper.

Figure 5:
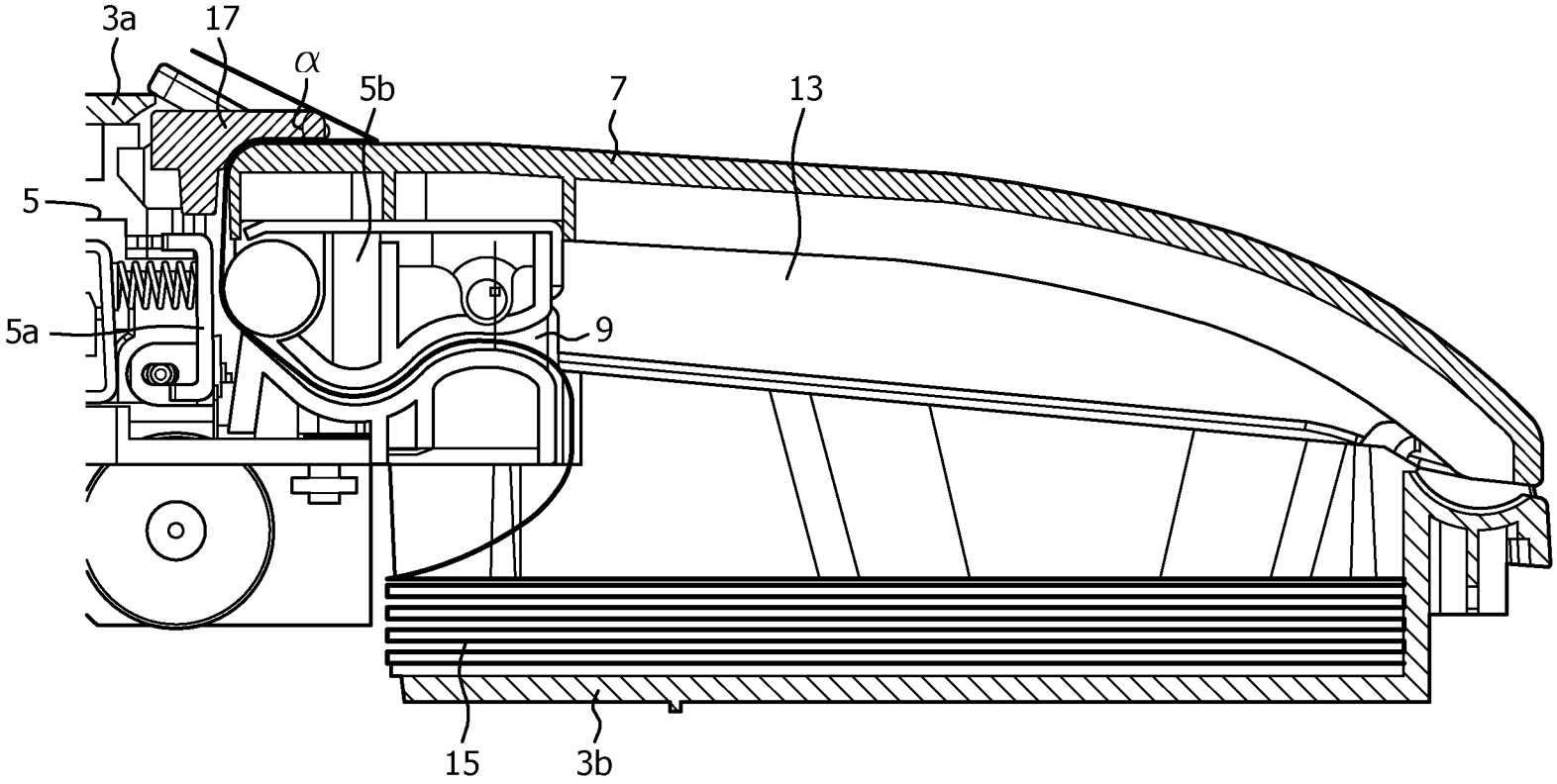
FIG. 5 is a sectional view taken along the line 4-4 of FIG. 1, showing that the printed paper is being torn off by means of a paper-tearing mechanism.

As shown in FIG. 2, the movable paper-tearing mechanism 17 according to a preferred embodiment comprises a main body 17*a* and a supporting shaft 17*b* extending from two ends of the main body 17*a*. A torsion spring 17*c* is attached to the respective supporting shaft 17*b*. The movable paper-tearing mechanism 17 is rotatably mounted below the top portion 3*a* of the housing 3 by means of the supporting shafts 17*b*. The torsion spring 17*c* always tends to rotate the movable paper-tearing mechanism 17 inwards relative to the housing 3 to move it away from the paper outlet 11. The movable paper-tearing mechanism 17 further comprises a step 17*d* extending from the main body 17*a*. The openable top cover 7 comprises a projection 7*a* at a position corresponding to the step 17*d*. When the openable top cover 7 is closed, the projection 7*a* of the openable top cover 7 presses against the step 17*d* of the movable paper-tearing mechanism 17 and overcomes a spring force of the torsion spring 17*c*, so that the movable paper-tearing mechanism 17 rotates outwards relative to the housing 3 to move into the paper outlet 11 and overlap partly the openable top cover 7. As a result, the extension 9*a* of the paper channel 9 is defined between the movable paper-tearing mechanism 17 and the upper surface of the openable top cover 7, as shown in FIGS. 4 and 5. It should be understood that the matching portions between the movable paper-tearing mechanism 17 and the openable top cover 7 are not limited to being in the form of the step 17*d* and the projection 7*a*. They may be in the form of any type of matching portions as long as they can cooperate with each other so as to rotate the movable paper-tearing mechanism 17 outwards relative to the housing 3 to move it into the paper outlet 11. Preferably, the main body 17*a* of the movable paper-tearing mechanism 17 is substantially sheet-shaped and has a serrated edge 17*e* to facilitate tearing off of the printed paper.

Although, in the preferred embodiment, the movable paper-tearing mechanism is rotatably mounted below the top portion of the housing, said movable paper-tearing mechanism may alternatively be slidably mounted below the top portion of the housing for example by means of a rail, and a tension spring always tends to slide the movable paper-tearing mechanism inwards relative to the housing so as to move it away from the paper outlet. When the openable top cover is closed, the matching portions between the openable top cover and the movable paper-tearing mechanism cooperate with each other and overcome the spring force of the tension spring, so that the movable paper-tearing mechanism slides outwards relative to the housing to move into the paper outlet and overlap partly the openable top cover. As a result, the extension of the paper channel is defined between the movable paper-tearing mechanism and the upper surface of the openable top cover.

According to the printer of the present invention, the movable paper-tearing mechanism moves away from the paper outlet when the openable top cover is opened, thereby facilitating loading the paper. Unlike the conventional printer, it is unnecessary to insert manually the paper through the paper outlet disposed in the openable top cover. The loading of the paper therefore becomes simple and convenient. When the openable top cover is closed, the movable paper-tearing mechanism overlaps partly the openable top cover, so that the extension of the paper channel is defined between the movable paper-tearing mechanism and the upper surface of the openable top cover, thereby changing the outputting direction of the printed paper. Two portions of the paper on either side of the movable paper-tearing mechanism thus may form an acute angle $\alpha$, as shown in FIG. 5. As a result, it is easy to tear the paper, enabling the paper to be torn off in a regular manner and in a straight line.

Although the present invention is described with reference to the preferred embodiment, it should be understood that such detailed description is only for illustrative purposes but does not limit the present invention. The scope of the claimed invention should be defined by the appended claims.

The invention claimed is:

1. A printer comprising:

a housing;

openable top cover disposed at the top of the housing;

a printing unit disposed in the housing, the printing unit comprising a printing portion fixedly mounted within the housing and a roll portion fixed to the openable top cover, and a paper channel defined between the printing portion and the roll portion;

a paper outlet defined between a top portion of the housing and the openable top cover, the paper channel leading to the paper outlet; and a movable paper-tearing mechanism disposed in the paper outlet, wherein the movable paper-tearing mechanism comprises: a) a torsion spring configured with a force that moves the movable paper-tearing mechanism out of the paper outlet when the openable top cover is open; and b) a first mating portion, the openable top cover comprises a second mating portion, and the first and second mating portions cooperate with each other and overcome a spring force of the torsion spring when the openable top cover is closed so that the movable paper-tearing mechanism moves into the paper outlet to define an extension of the paper channel between the movable paper-tearing mechanism and an upper surface of the openable top cover, wherein the first and second mating portions comprise a step extending from a main body and a projection on the openable top cover at a position corresponding to the step.

2. The printer according to claim 1, wherein the movable paper-tearing mechanism moves away from the paper outlet when the openable top cover is opened and moves into the paper outlet and overlaps partly the openable top cover when the openable top cover is closed, defining the extension of the paper channel between the movable paper-tearing mechanism and the upper surface of the openable top cover.

3. The printer according to claim 1, wherein the movable paper-tearing mechanism has a serrated edge.

4. The printer according to claim 1, wherein the printer is a thermal printer.

5. A printer comprising:

a housing;

openable top cover disposed at the top of the housing;

a printing unit disposed in the housing, the printing unit comprising a printing portion fixedly mounted within the housing and a roll portion fixed to the openable top cover, and a paper channel defined between the printing portion and the roll portion;

a paper outlet defined between a top portion of the housing and the openable top cover, the paper channel leading to the paper outlet; and a movable paper-tearing mechanism disposed in the paper outlet, the movable paper-tearing mechanism moving away from the paper outlet when the openable top cover is opened and moving into the paper outlet and overlapping partly the openable top cover when the openable top cover is closed, so that an extension of the paper channel is defined between the movable paper-tearing mechanism and an upper surface of the openable top cover;

wherein the movable paper-tearing mechanism comprises a torsion spring and a first mating portion, the openable top cover comprise a second mating portion, and the first and second mating portions cooperate with each other and overcome a spring force of the torsion spring when the openable top cover is closed so that the movable paper-tearing mechanism moves into the paper outlet to define the extension of the paper channel, wherein the first and second mating portions comprise a step extending from a main body and a projection on the openable top cover at a position corresponding to the step.

6. The printer according to claim 5, wherein the movable paper-tearing mechanism is rotatably mounted below the top portion of the housing.

7. The printer according to claim 6, wherein the movable paper-tearing mechanism comprises the main body and a supporting shaft extending from two ends of the main body, wherein the torsion spring is attached to the supporting shaft, and the movable paper-tearing mechanism being rotatably mounted below the top portion of the housing by means of the supporting shafts.

* * * * *